US011369233B2

(12) United States Patent
Li et al.

(10) Patent No.: US 11,369,233 B2
(45) Date of Patent: Jun. 28, 2022

(54) SOAP DISPENSER FOR USE IN HOTEL BATHROOM

(71) Applicant: JIANGSU OPPEAL DAILY COSMETICS CORP., LTD, Yangzhou (CN)

(72) Inventors: Jingjing Li, Yangzhou (CN); Mingyang Chen, Yangzhou (CN); Aijun Luo, Yangzhou (CN)

(73) Assignee: JIANGSU OPPEAL DAILY COSMETICS CORP., LTD, Yangzhou (CN)

( * ) Notice: Subject to any disclaimer, the term of this patent is extended or adjusted under 35 U.S.C. 154(b) by 85 days.

(21) Appl. No.: 16/886,786

(22) Filed: May 29, 2020

(65) Prior Publication Data

US 2021/0113030 A1 Apr. 22, 2021

(30) Foreign Application Priority Data

Oct. 18, 2019 (CN) ..... 201921754263.6

(51) Int. Cl.
*A47K 3/28* (2006.01)
*A47K 5/12* (2006.01)
*A47K 5/122* (2006.01)

(52) U.S. Cl.
CPC ..... *A47K 3/281* (2013.01); *A47K 5/122* (2013.01); *A47K 5/1211* (2013.01)

(58) Field of Classification Search
CPC ..... A47K 3/281; A47K 5/1211; A47K 5/122
See application file for complete search history.

(56) References Cited

U.S. PATENT DOCUMENTS 2,659,517 A * 11/1953 Reinhardt, Jr. ..... A47K 5/1211 222/82
2,772,817 A * 12/1956 Jauch ..... F04B 43/0063 222/207
3,926,347 A * 12/1975 Low ..... A47K 5/122 222/181.2
4,166,553 A * 9/1979 Fraterrigo ..... A47K 5/122 222/181.2

(Continued)

FOREIGN PATENT DOCUMENTS

CN 200971226 Y 11/2007
CN 105686724 A 6/2016

(Continued)

*Primary Examiner* — Vishal Pancholi
*Assistant Examiner* — Bob Zadeh
(74) *Attorney, Agent, or Firm* — Bayramoglu Law Offices LLC

(57) ABSTRACT

A soap dispenser for use in a hotel bathroom includes a bottle body, a sealing cover and a positioning frame, wherein the bottle body is used for containing shampoo or shower gel, and the bottle body is placed upside down; the sealing cover is connected to and covers a bottle mouth of the bottle body, a liquid discharge hole is provided in the center of the sealing cover, the liquid discharge hole is provided with a barrier sheet made of silica gel, and a cutout is provided at the center of the barrier sheet; and the positioning frame is used for fixing the bottle body to a wall of the bathroom. The problem in the prior art of inconvenience m use when a hotel guest takes a bath and needs to press a pressing valve on a bottle body when using bathroom amenities is solve.

3 Claims, 6 Drawing Sheets

(56) References Cited

U.S. PATENT DOCUMENTS

| | | | | | |
|---|---|---|---|---|---|
| 4,728,006 | A * | 3/1988 | Drobish | B65D 1/32 | 222/181.3 |
| 5,105,984 | A * | 4/1992 | Kazimir | A47K 5/122 | 222/103 |
| 8,870,031 | B2 * | 10/2014 | Hagleitner | A47K 5/1208 | 222/173 |
| 2002/0070240 | A1 * | 6/2002 | Dorman | A47K 5/1211 | 222/209 |
| 2012/0199609 | A1 * | 8/2012 | Schwenkenberg | A47K 5/122 | 222/181.3 |
| 2018/0235409 | A1 * | 8/2018 | Ciavarella | A47K 5/12 | |
| 2021/0113030 | A1 * | 4/2021 | Li | A47K 5/1211 | |

FOREIGN PATENT DOCUMENTS

| | | | | |
|---|---|---|---|---|
| DE | 102010007514 | A1 | 8/2011 | |
| KR | 20100012997 | A | 2/2010 | |
| WO | 2005044673 | A2 | 5/2005 | |
| WO | WO-2005044673 | A2 * | 5/2005 | B65D 1/32 |

* cited by examiner

SOAP DISPENSER FOR USE IN HOTEL BATHROOM

CROSS REFERENCES TO THE RELATED APPLICATIONS

This application is based upon and claims priority to Chinese Patent Application No. 201921754263.6, filed on Oct. 18, 2019, the entire contents of which are incorporated herein by reference.

TECHNICAL FIELD

An embodiment of the present invention relates to the technical field of daily necessities for hotels, and in particular to a soap dispenser for use in a hotel bathroom.

BACKGROUND

Currently, separate bathrooms and washrooms are generally provided in hotels. In order to facilitate people in checking in and washing, liquid soap such as shampoo or shower gel is generally placed in the washroom for people to use directly during washing.

At present, when placing shampoo or other liquid soap in the hotel, a support plate is fixed on a wall of the bathroom for supporting purpose, and then the bathroom amenities are placed directly on the support plate for use, but when using same in this manner, a pressing valve at an upper end of the bathroom amenities needs to be pressed during use, which makes it relatively inconvenient to use. At the same time, since there will be a lot of water vapor in the bathroom during bathing, a person will have poor eyesight, so that these amenities are likely to be directly knocked off and drop to the ground, and may even hit his/her foot and cause some damage to his/her foot, so it is relatively inconvenient to directly place the bathroom amenities on the support plate and press same, and they are likely to be knocked off and hit his/her foot.

SUMMARY

To this end, the embodiments of the present invention provide a soap dispenser for use in a hotel bathroom to solve the problem in the prior art of inconvenience in use when a hotel guest takes a bath and needs to press a pressing valve on a bottle body when using bathroom amenities.

In order to achieve the above object, the embodiments of the present invention provide the following technical solutions.

According to a first aspect of embodiments of the present invention, a soap dispenser for use in a hotel bathroom comprises:

a bottle body for containing shampoo or shower gel, wherein the bottle body is placed upside down;

a sealing cover connected to and covering a bottle mouth of the bottle body, wherein a liquid discharge hole is provided in the center of the sealing cover, the liquid discharge hole is provided with a barrier sheet, wherein the barrier sheet is, made of silica gel, and a cutout is provided at a center of the barrier sheet; and a positioning frame for fixing the bottle body to a wall of the bathroom, Further, the positioning frame comprises a fixing plate and a mounting ring, wherein the mounting ring is fixed to a lower end of the fixing plate, the fixing plate is fixed to the wall of the bathroom via a plurality of bolts, an upper end face of the mounting ring is provided with an annular snap groove, the bottle mouth of the bottle body extends into the mounting ring, and a lower end face of the bottle body abuts against the snap groove.

Further, a limiting groove is provided at an upper end of an inner annular face of the mounting ring, a limiting block is fixed to a side of the battle body. the bottle mouth is located on the side of the bottle body, and after the bottle mouth of the bottle body extends into the mounting ring, the limiting block is snapped into the limiting groove.

According to a second aspect of embodiments of the present invention, a soap dispenser for use in a hotel bathroom comprises:

a bottle body for containing a shampoo or a shower gel. wherein the bottle body is placed upside down; a sealing cover connected to and covering a bottle mouth of the bottle body, wherein a liquid discharge hole is provided in a center of the sealing cover, the liquid discharge hole is provided with a barrier sheet, wherein the barrier sheet is made of silica gel, and a cutout is provided at a center of the barrier sheet; and a positioning frame for fixing the bottle body to a wall of the hotel bathroom, wherein the positioning frame further comprises a positioning sheet, the positioning sheet is fixed to an upper end of the fixing plate, and the positioning sheet is provided with an anti-drop assembly for fixing the bottle body.

Further, the anti-drop assembly comprises a circular arc sheet fixed to a lower end of the positioning sheet and an arc-shaped clamping sheet hinged to one side of the circular arc sheet, and a locking block is integrally connected to an upper end of the bottle body; after the bottle body is snapped into the mounting ring, a side wall of the locking block abuts against the circular arc sheet, and the arc-shaped clamping sheet is snapped to a side wall of the locking block; and a locking assembly is provided between the arc-shaped clamping sheet and the positioning plate.

Further, the locking assembly comprises a locking portion and an unlocking portion, The unlocking portion is a magnet, the locking portion comprises a sleeve provided at the lower end of the positioning sheet, a fixing block and a magnetic bar are provided inside the sleeve, wherein the fixing block is fixed to an edge of a lower end of the sleeve, and a through hole is provided in a middle portion of the fixing block. The magnetic bar penetrates the through hole and extends out of the fixing block, a back-springing sheet is fixed to the magnetic bar inside the sleeve, and a spring is sleeved to the magnetic bar at an upper end of the back-springing sheet. An upper end of the spring abuts against the positioning sheet at an upper end portion of the sleeve, and a lower end of the spring abuts against the back-springing sheet. A snapping sheet is fixed to the arc-shaped clamping sheet, and the snapping sheet is provided with a hole. After the arc-shaped clamping sheet abuts against an edge of the locking block, a lower end of the magnetic bar is snapped into the hole of the snapping sheet.

The embodiments of the present invention have the following advantages:

1) After the bottle body is placed upside down and fixed to the wall of the bathroom by using the positioning frame, when a person uses the bottle body, the bottle body is prevented from dropping and hitting his/her foot or other position, 2) With the barrier sheet provided at the liquid discharge hole of the sealing cover and the cutout provided on the barrier sheet, the liquid can be squeezed out of the bottle body by squeezing the bottle body, thereby making it more convenient to use and facilitating a hotel guest in using it and increasing the guest's experience.

BRIEF DESCRIPTION OF THE DRAWINGS

To describe the technical solutions in the implementations of the present invention or in the prior art more clearly, the following briefly introduces the accompanying drawings required for describing the implementations or the prior art. It is obvious that the drawings in the following description are merely exemplary, and for those of ordinary skill in the art, other implementation drawings would have been derived from the extension of the provided drawings without involving any inventive effort.

The structures, proportions, sizes and the like depicted in this specification are only used to fit with the content disclosed in the specification for understanding and reading by those skilled in the art, but are not intended to limit the limitation conditions that can be implemented in the present invention, and thus have no technically substantive meaning. Any of the modification of structure, the change of proportional relationship or the adjustment of size should fall within the scope covered by the technical content disclosed in the present invention without affecting the effects produced and the object achievable by the present invention.

In the figures: 1. Bottle body; 2. Sealing cover; 21. Barrier sheet; 22. Cutout; 31. Fixing plate; 32. Mounting ring; 33. Snap groove; 34. Limiting groove; 35. Limiting block; 36. Positioning sheet; 4. Locking block; 50. Circular arc sheet; 51. Arc-shaped clamping sheet; 61. Sleeve; 62. Magnetic bar; 63. Fixed block; 64. Back-springing sheet; 65. Spring; 66. Snapping sheet.

DETAILED DESCRIPTION OF THE EMBODIMENTS

The embodiments of the present invention are illustrated below by using the specific embodiments, and those skilled in the art would have readily understood other advantages and effects of the present invention from the disclosure of this description, and it is obvious that the described embodiments are some of the embodiments of the present invention rather than all the embodiments. All other embodiments obtained by those of ordinary skill in the art based on the embodiments of the present invention without any inventive effort shall fall within the scope of protection of the present invention.

Embodiments

Figure 1:
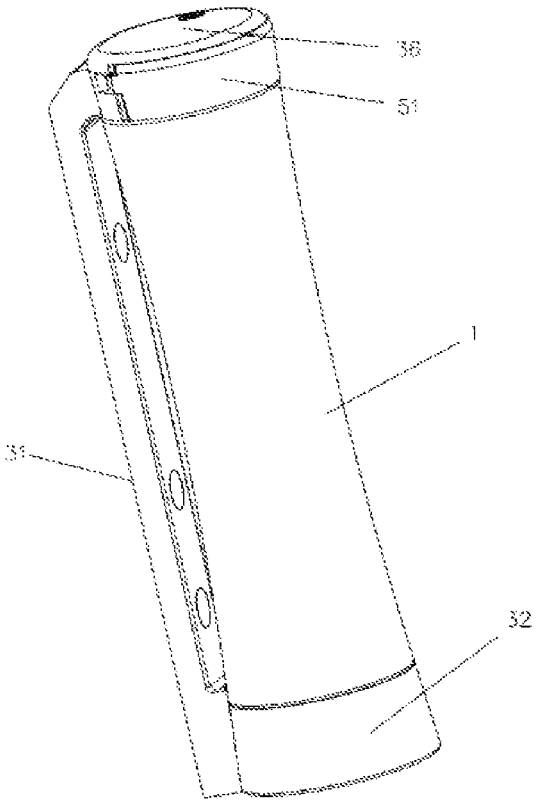
FIG. 1 is a schematic diagram of the overall structure of a soap dispenser provided in an embodiment of the present invention.
Figure 2:
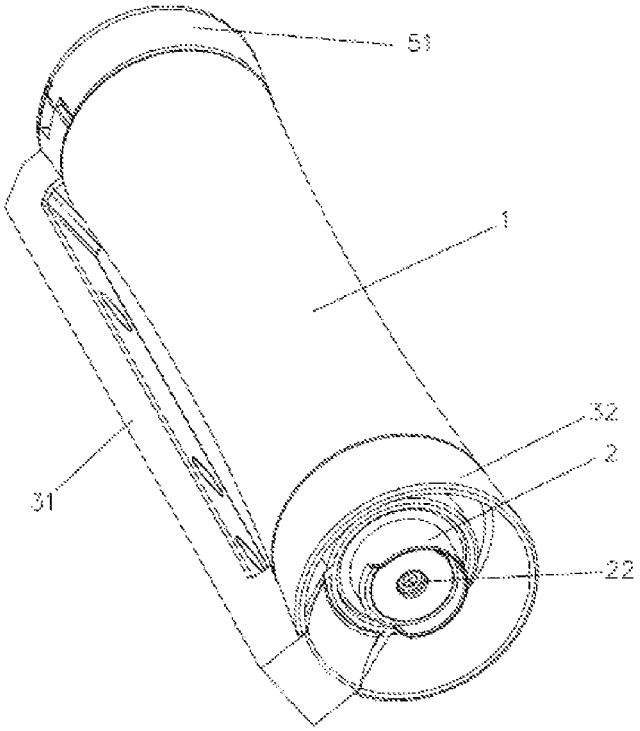
FIG. 2 is a schematic structural diagram from the bottom of the soap dispenser provided in the embodiment of the present invention.

A soap dispenser for use in a hotel bathroom, as shown in FIGS. 1 and 2, comprises a bottle body 1 for containing shampoo or shower gel, and a positioning frame for fixing the bottle body 1 to a wall of the bathroom, wherein the bottle body 1 is placed upside down, a sealing cover 2 is provided at a bottle mouth of the bottle body 1, and the sealing cover 2 is in threaded connection to the bottle mouth of the bottle body 1, such that the sealing cover 2 is stably fixed to the bottle mouth.

A liquid discharge hole is provided in the center of the sealing cover 2, a barrier sheet 21 made of silica gel is fixedly connected to the liquid discharge hole, a cross-shaped cutout 22 is provided in the center of the barrier sheet 21. In additional, the positioning frame can be used to fix the bottle body 1.

In use, since the barrier sheet 21 made of silica gel has a certain elasticity, and only the cutout 22 is provided on the barrier sheet 21, when a liquid in the bottle body 1 is not subjected to a certain pressure, the liquid therein will not break through the cutout 22 on the barrier sheet 21 to flow out; and when the liquid therein needs to be used, the bottle body 1 can be compressed, at this time, the liquid therein can be squeezed out of the cutout 22, and the cutout 22 on the barrier sheet 21 will be automatically retracted and closed after stopping squeezing. In this way, the soap dispenser is more convenient when in use, whereas the phenomenon that the bottle body drops will not occur because the positioning frame fixes the bottle body 1 to the wall.

Figure 3:
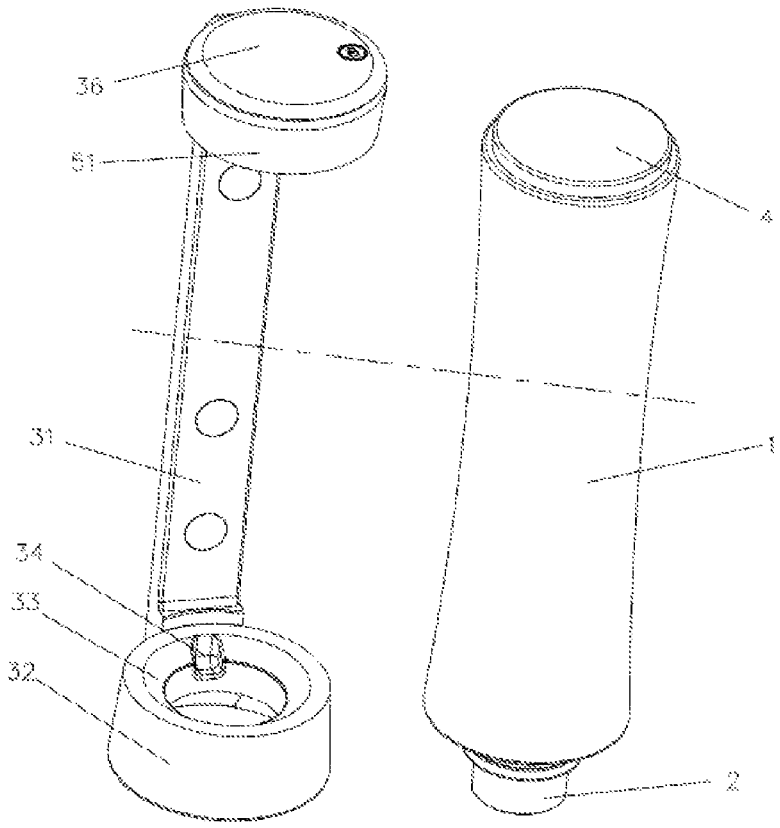
FIG. 3 is a schematic exploded structural diagram of the soap dispenser provided in the embodiment of the present invention.

As shown in conjunction with FIG. 3, the positioning frame comprises a fixing plate 31 and a mounting ring 32, wherein the mounting ring 32 is fixedly connected to an end of the fixing plate 31, the fixing plate 31 is provided with a plurality of bolts, and the fixing plate 31 is fixed to the wall of the bathroom via the bolts. An upper end face of the mounting ring 32 is additionally provided with an annular snap groove 33. After the bottle mouth at a lower end of the bottle body 1 extends into the mounting ring 32, the sealing cover 2 is snapped to an inner annular face of the mounting ring 32, a lower end face of the bottle body 1 abuts against the snap groove 33, and a side wall at a lower end portion of the bottle body 1 is snapped to an edge of the snap groove 33, such that the bottle body 1 can be relatively stably fixed in the mounting ring 32, while not affecting the discharge of the liquid from the bottle body 1.

Figure 4:
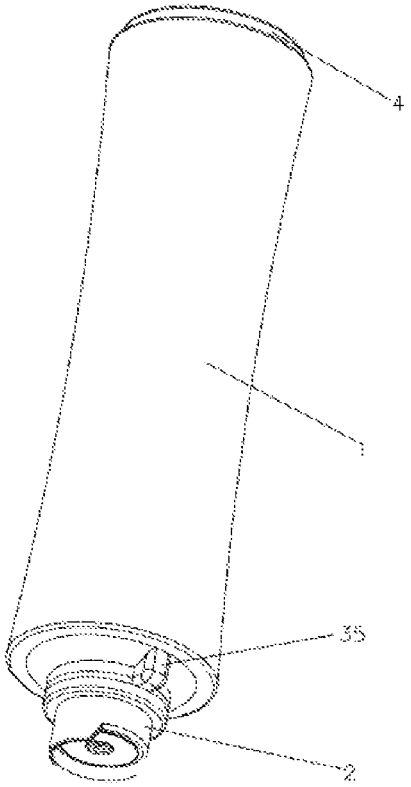
FIG. 4 is a schematic structural diagram of a bottle body of the soap dispenser provided in the embodiment of the present invention.

As shown in conjunction with FIG. 4, a limiting groove 34 is provided on an upper end of the inner annular face of the mounting ring 32, and the limiting groove 34 is located on the side close to the fixing plate 31. A limiting block 35 is fixedly connected to the bottle body 1 on the side where the bottle mouth is located. After the bottle mouth of the bottle body 1 extends into the mounting ring 32, the limiting block 35 is snapped into the limiting groove 34, such that when a person squeezes the bottle body 1, the bottle body 1 can be prevented from rotating relative to the mounting ring 32 to a certain extent, which facilitates the person in squeezing the liquid out of the bottle body 1 more conveniently.

The positioning frame further comprises a positioning sheet 36, the positioning sheet 36 is fixedly connected to an upper end of the fixing plate 31, and the positioning sheet 36 is provided with an anti-drop assembly for fixing the bottle body 1, so as to further prevent the bottle body 1 from dropping to the ground when in use, while others can be prevented from taking the bottle body 1 off the positioning frame.

Figure 5:
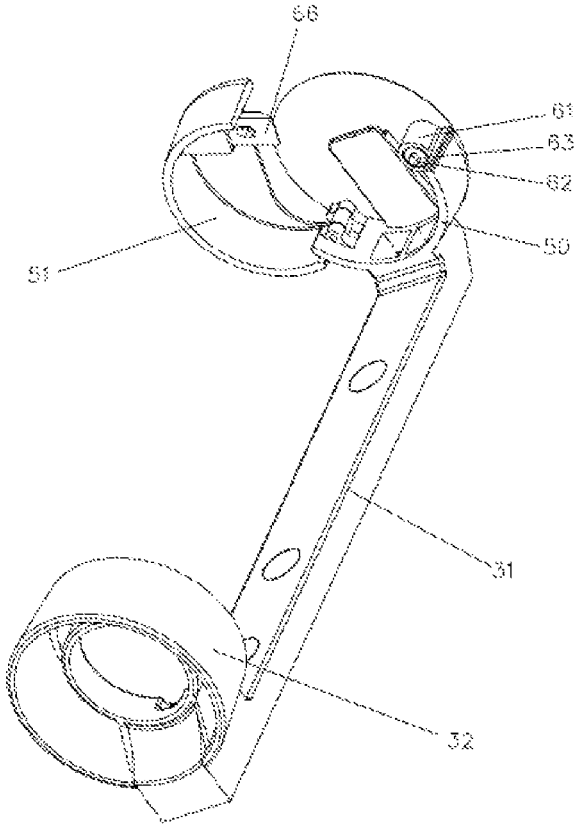
FIG. 5 is a schematic structural diagram of the soap dispenser provided in the embodiment of the present invention with an arc-shaped clamping sheet being opened.

As shown in conjunction with FIG. 5, the anti-drop assembly comprises a circular arc sheet 50 fixedly connected to a lower end of the positioning sheet 36 and an arc-shaped clamping sheet 51 hinged to one side of the circular arc sheet 50, and a circular locking block 4 is integrally connected to an upper end of the bottle body 1. After the bottle body 1 is snapped into the mounting ring 32, a side wall of the locking block 4 abuts against the circular arc sheet 50, the arc-shaped clamping sheet 51 can be snapped to a side wall of the locking block 4 at another position by rotating the arc-shaped clamping sheet 51. A locking assembly is provided between the arc-shaped clamping sheet 51 and the positioning plate to fix the arc-shaped clamping sheet 51 to the positioning plate, and after being fixed by the locking assembly, the arc-shaped clamping sheet 51 is prevented from being opened, so as to stably fix the bottle body 1.

Figure 6:
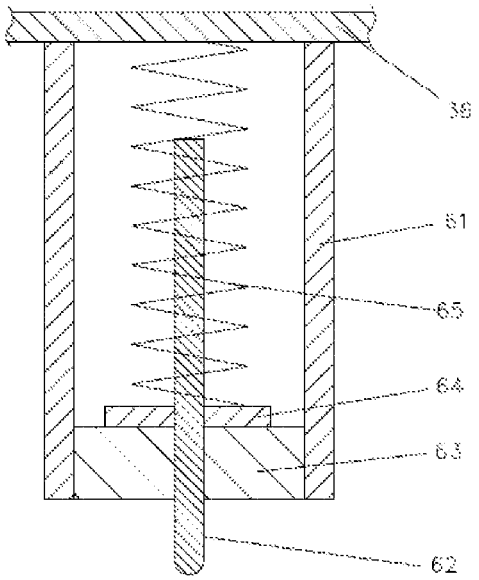
FIG. 6 is a schematic cross-sectional structural diagram inside a sleeve of the soap dispenser provided in the embodiment of the present invention.

As shown in conjunction with FIG. 6, the locking assembly comprises a locking portion and an unlocking portion, wherein the unlocking portion is a magnet, the locking portion comprises a sleeve 61 fixedly connected to a lower end of the positioning sheet 36, a fixing block 63 and a magnetic bar 62 are provided inside the sleeve 61, the fixing block 63 is fixedly connected to an edge of a lower end of the sleeve 61, and a through hole is provided in a middle portion of the fixing block 63. The magnetic bar 62 penetrates the through hole and extends out of the fixing block 63, a back-springing sheet 64 is fixed to the magnetic bar 62 inside the sleeve 61, and a spring 65 is sleeved to the magnetic bar 62 at an upper end of the back-springing sheet 64. An upper end of the spring 65 abuts against the positioning sheet 36 at an upper end portion of the sleeve 61, and a lower end of the spring abuts against the back-springing sheet 64. In addition, a snapping sheet 66 is fixedly connected to the arc-shaped clamping sheet 51, and the snapping sheet 66 is provided with a hole. After the arc-shaped clamping sheet 51 abuts against an edge of the locking block 4, the snapping sheet 66 moves to the position of the magnetic bar 62, and a lower end of the magnetic bar 62 is snapped into the hole of the snapping sheet 66 to fix the arc-shaped clamping sheet 51. When the arc-shaped clamping sheet needs to be opened, only the magnet needs to be placed on the positioning sheet 36 at the upper end of the sleeve 61, which can attract the magnetic bar 62 to retract and open the arc-shaped clamping sheet 51, thereby making it more convenient to use.

In the present invention, after the bottle body 1 is placed upside down and fixed to the wall of the bathroom by using the positioning frame, when a person uses the bottle body 1, the bottle body 1 is prevented from dropping and hitting his/her foot or other position; in addition, with the barrier sheet 21 provided at the liquid discharge hole of the sealing cover 2 and the cutout 22 provided on the barrier sheet 21, the liquid can be squeezed out of the bottle body 1 by squeezing the bottle body, thereby making it more convenient to use and facilitating a hotel guest in using it, and increasing the guest's experience.

Although the present invention has been described in detail above with the general description and particular embodiments, on the basis of the present invention, some modifications or improvements can be made thereto, which would have been obvious to those skilled in the art. Therefore, these modifications or improvements made without departing from the spirit of the present invention all fall within the scope of protection of the present invention.

What is claimed is:

1. A soap dispenser for use in a hotel bathroom, comprising:

a bottle body for containing a shampoo or a shower gel, wherein the bottle body is placed upside down;

a sealing cover connected to and covering a bottle mouth of the bottle body, wherein a liquid discharge hole is provided in a center of the sealing cover, the liquid discharge hole is provided with a barrier sheet, wherein the barrier sheet is made of silica gel, and a cutout is provided at a center of the barrier sheet; and a positioning frame for fixing the bottle body to a wall of the hotel bathroom, wherein the positioning frame comprises a fixing plate and a mounting ring, wherein the mounting ring is fixed to a lower end of the fixing plate, the fixing plate is fixed to the wall of the hotel bathroom via a plurality of bolts, an upper end face of the mounting ring is provided with an annular snap groove, the bottle mouth of the bottle body extends into the mounting ring, and a lower end face of the bottle body abuts against the annular snap groove, wherein a limiting groove is provided at an upper end of an inner annular face of the mounting ring, a limiting block is fixed to a side of the bottle body, the bottle mouth is located on the side of the bottle body, and after the bottle mouth of the bottle body extends into the mounting ring, the limiting block is snapped into the limiting groove.

2. A soap dispenser for use in a hotel bathroom, comprising:

a bottle body for containing a shampoo or a shower gel, wherein the bottle body is placed upside down;

a sealing cover connected to and covering a bottle mouth of the bottle body. wherein a liquid discharge hole is provided in a center of the sealing cover, the liquid discharge hole is provided with a barrier sheet, wherein the barrier sheet is made of silica gel, and a cutout is provided at a center of the barrier sheet; and positioning frame for fixing the bottle body to a wall of the hotel bathroom, wherein the positioning frame further comprises a positioning sheet, the positioning sheet is fixed to an upper end of a fixing plate, and the positioning sheet is provided with an anti-drop assembly for fixing the bottle body, wherein the anti-drop assembly comprises a circular arc sheet fixed to a lower end of the positioning sheet and an arc-shaped clamping sheet hinged to a side of the circular arc sheet, and a locking block is integrally connected to an upper end of the bottle body; after the bottle body is snapped into a mounting ring, a side wall of the locking block abuts against the circular arc sheet, and the arc-shaped clamping sheet is snapped to the side wall of the locking block; and a locking assembly is provided between the arc-shaped clamping sheet and a positioning plate.

3. The soap dispenser for use in the hotel bathroom according to claim 2, wherein the locking assembly comprises a locking portion and an unlocking portion, the unlocking portion is a magnet, the locking portion comprises a sleeve provided at the lower end of the positioning sheet, a fixing block and a magnetic bar are provided inside the sleeve, wherein the fixing block is fixed to an edge of a lower end of the sleeve, and a through hole is provided in a middle portion of the fixing block;

the magnetic bar penetrates the through hole and extends out of the fixing block, a back-springing sheet is fixed to the magnetic bar inside the sleeve, and a spring is sleeved to the magnetic bar at an upper end of the back-springing sheet;

an upper end of the spring abuts against the positioning sheet at an upper end portion of the sleeve, and a lower end of the spring abuts against the back-springing sheet;

a snapping sheet is fixed to the arc-shaped clamping sheet, and the snapping sheet is provided with a hole; and after the arc-shaped clamping sheet abuts against an edge of the locking block, a lower end of the magnetic bar is snapped into the hole of the snapping sheet.

* * * * *